US008881444B2

(12) United States Patent
Warburton et al.

(10) Patent No.: US 8,881,444 B2
(45) Date of Patent: Nov. 11, 2014

(54) STOCK BEDDING SYSTEM FOR FIREARM

(71) Applicant: Sturm, Roger & Company, Inc., Southport, CT (US)

(72) Inventors: Scott Warburton, South Acworth, NH (US); Bruce Rozum, Vernon, CT (US); Dwight Potter, Unity, NH (US)

(73) Assignee: Sturm, Ruger & Company, Inc.

( * ) Notice: Subject to any disclaimer, the term of this patent is extended or adjusted under 35 U.S.C. 154(b) by 26 days.

(21) Appl. No.: 13/715,264

(22) Filed: Dec. 14, 2012

(65) Prior Publication Data

US 2014/0026460 A1 Jan. 30, 2014

Related U.S. Application Data

(60) Provisional application No. 61/570,605, filed on Dec. 14, 2011.

(51) Int. Cl.

| | |
|---|---|
| ***F41A 11/00*** | (2006.01) |
| ***F41C 23/06*** | (2006.01) |
| ***F41C 23/00*** | (2006.01) |

(52) U.S. Cl.

CPC ..... *F41C 23/06* (2013.01); *F41A 11/00* (2013.01); *F41C 23/00* (2013.01)

USPC ..... 42/75.03; 42/74; 42/75.01

(58) Field of Classification Search

CPC ..... F41C 23/06; F41A 3/64; F41A 3/66; F41A 11/00; F41A 11/02

USPC ..... 42/74, 75.01, 75.02, 75.03, 75.1

See application file for complete search history.

(56) References Cited

U.S. PATENT DOCUMENTS

| | | | | |
|---|---|---|---|---|
| 512,434 | A * | 1/1894 | Davenport | 42/75.02 |
| 2,124,066 | A | 7/1938 | Hester | |
| 2,136,396 | A | 11/1938 | Savage | |
| 2,479,594 | A * | 8/1949 | Yasho | 42/75.01 |

(Continued)

FOREIGN PATENT DOCUMENTS

| | | |
|---|---|---|
| EP | 1357348 | 4/2003 |
| EP | 1348928 | 10/2003 |

(Continued)

OTHER PUBLICATIONS

Corresponding International Search Report dated Feb. 15, 2013.

*Primary Examiner* — Bret Hayes
*Assistant Examiner* — Derrick Morgan
(74) *Attorney, Agent, or Firm* — The Belles Group, P.C.

(57) ABSTRACT

A stock bedding system for a firearm is disclosed. In one embodiment, the stock bedding system includes a stock having a pair of bearing surfaces that are configured and arranged to mutually engage a mating pair of bearing surfaces formed on the barrel-receiver assembly. At least one of the four bearing surfaces has a predetermined convex surface profile which causes the barrel-receiver assembly to roll in an angular direction away from one lateral side of the stock towards the opposite lateral side when the barrel-receiver assembly is mounted to the stock. The convex surface profile acts to tighten the engagement between the opposing bearing surfaces of the barrel-receiver assembly and stock providing a secure and vibration resistant mounting. In one embodiment, the convex-shaped bearing surface is defined by a pillar lug mounted in the stock which engages a mating substantially flat bearing surface formed on the barrel-receiver assembly.

29 Claims, 10 Drawing Sheets

(56) References Cited

U.S. PATENT DOCUMENTS

| | | | | |
|---|---|---|---|---|
| 2,719,460 | A * | 10/1955 | Leek | 89/37.04 |
| 2,765,563 | A | 10/1956 | Roper et al. | |
| 2,867,931 | A * | 1/1959 | Schreiber | 42/75.01 |
| 2,967,368 | A | 1/1961 | Williams | |
| 3,206,885 | A * | 9/1965 | Dye | 42/75.03 |
| 3,439,441 | A | 4/1969 | Lawley | |
| 3,711,983 | A | 1/1973 | Allyn | |
| 3,979,849 | A | 9/1976 | Haskins | |
| 4,406,080 | A * | 9/1983 | Badali | 42/75.01 |
| 4,791,748 | A | 12/1988 | Leskinen | |
| 5,020,260 | A * | 6/1991 | Houghton | 42/75.02 |
| 5,115,588 | A | 5/1992 | Bronsart et al. | |
| 5,410,834 | A * | 5/1995 | Benton et al. | 42/75.02 |
| 5,433,027 | A | 7/1995 | Sprangers | |
| 5,540,008 | A * | 7/1996 | Kirnstatter | 42/75.02 |
| 5,615,508 | A | 4/1997 | Miller et al. | |
| 5,907,919 | A * | 6/1999 | Keeney | 42/75.02 |
| 6,301,817 | B1 * | 10/2001 | Hogue et al. | 42/71.01 |
| 6,487,805 | B1 * | 12/2002 | Reynolds | 42/75.03 |
| 6,499,246 | B1 * | 12/2002 | Zedrosser | 42/75.03 |
| 6,516,549 | B1 | 2/2003 | Hildebrandt et al. | |
| 6,526,683 | B1 | 3/2003 | Crandall | |
| 6,637,142 | B1 * | 10/2003 | Reynolds | 42/75.03 |
| 6,722,074 | B1 | 4/2004 | Farrell | |
| 6,889,462 | B1 | 5/2005 | Carlson | |
| 7,726,060 | B1 * | 6/2010 | Jones | 42/75.02 |
| 7,802,392 | B2 | 9/2010 | Peterson et al. | |
| 7,841,119 | B1 * | 11/2010 | Boyd | 42/71.01 |
| 7,866,078 | B1 * | 1/2011 | Beretta | 42/75.03 |
| 7,905,041 | B1 * | 3/2011 | Davies | 42/75.02 |
| 8,015,740 | B2 * | 9/2011 | Jamison et al. | 42/69.02 |
| 8,230,633 | B1 * | 7/2012 | Sisk | 42/75.01 |
| 8,296,987 | B1 * | 10/2012 | Dlubak et al. | 42/75.01 |
| 8,607,687 | B2 * | 12/2013 | Cottle | 89/140 |
| 2004/0007124 | A1 * | 1/2004 | Nakatani | 89/196 |
| 2004/0211104 | A1 | 10/2004 | Eberle | |
| 2007/0006510 | A1 * | 1/2007 | McCormick | 42/75.02 |
| 2009/0077855 | A1 | 3/2009 | Pritchett | |
| 2009/0277067 | A1 * | 11/2009 | Gregg | 42/69.01 |
| 2010/0083551 | A1 | 4/2010 | Jamison | |
| 2010/0122482 | A1 | 5/2010 | Simms et al. | |
| 2010/0154274 | A1 * | 6/2010 | Stone | 42/75.03 |
| 2010/0162605 | A1 * | 7/2010 | Laney et al. | 42/25 |
| 2010/0175290 | A1 | 7/2010 | Duplessis et al. | |
| 2010/0281727 | A1 | 11/2010 | Quaedpeerds et al. | |
| 2010/0281733 | A1 | 11/2010 | Constant et al. | |
| 2010/0307042 | A1 | 12/2010 | Jarboe et al. | |
| 2011/0185618 | A1 * | 8/2011 | Jamison et al. | 42/75.03 |
| 2012/0204465 | A1 * | 8/2012 | Hasler | 42/75.03 |
| 2013/0205637 | A1 * | 8/2013 | Patel | 42/75.02 |
| 2014/0075802 | A1 * | 3/2014 | Dubois et al. | 42/16 |

FOREIGN PATENT DOCUMENTS

| | | |
|---|---|---|
| FR | 2728964 | 7/1996 |
| WO | 2728964 | 7/1996 |
| WO | 2004079288 | 9/2004 |
| WO | 2006105947 | 10/2006 |

* cited by examiner

STOCK BEDDING SYSTEM FOR FIREARM

The present application claims the benefit of priority to U.S. Provisional Application No. 61/570,605 filed Dec. 14, 2011, which is incorporated herein by reference in its entirety.

BACKGROUND OF THE DISCLOSURE

The present disclosure generally relates to firearms, and more particularly to stock bedding system suitable for a rifle or other type firearm.

Rifles such as bolt action, semi-automatic, and muzzle loading rifles generally include a stock, a receiver mounted to the stock, a barrel mounted to the receiver, and a bolt assembly including a cylindrical bolt that is axially movable in the receiver for opening and closing the breech. The bolt may include locking lugs at the front end which may be rotatably locked into the rear of the barrel adjacent the chamber to form a closed locked breech. The bolt may be rotated between locked and unlocked positions while in the closed breech position and also moved axially forward or rearward automatically or manually via a handle that protrudes laterally outwards from the bolt. The bolt is moved rearward for opening the breech to unload and eject spent cartridge casings from the chamber in the rear of the barrel. A new cartridge may then be inserted manually into the chamber or uploaded automatically from a magazine which is then fed into the chamber by moving the bolt forward to close the breech in preparation for firing the next round.

Stocks for rifles have traditionally been made of both natural materials (e.g. hardwoods) and synthetic materials (e.g. polymers). Approaches for mounting a receiver to the stock should optimally provide a secure and stable mount regardless of material that minimizes, to the greatest extent possible, vibration and relative axial, transverse, and/or torsional/twisting movement between the receiver and stock under the tremendous dynamic recoil forces generated by firing the rifle. The mounting, or stock "bedding" system as it is sometimes called in the art, can greatly affect the accuracy and point of impact of the rifle if the foregoing relative movement becomes excessive between the stock and receiver.

An improved stock bedding system is desired for a firearm.

SUMMARY OF THE DISCLOSURE

A stock bedding system for a firearm is provided. In some embodiments, without limitation, the firearm may be a bolt action, semi-automatic, or muzzle-loading rifle. In one embodiment, the stock bedding system provides an automatic receiver positioning mechanism for secure mounting of the receiver to the stock. In one embodiment, the stock bedding system utilizes a stock having one or more recoil pillar lugs each having an opposing pair of facing bearing surfaces that are configured and arranged to mutually engage a mating pair of bearing surfaces formed on the receiver. In one embodiment, at least one of the combination of four bearing surfaces in each pair of mating stock-receiver bearing surfaces has a transverse arcuate convex surface profile which causes the receiver to slightly roll in an angular direction towards one opposing lateral side of the stock when the receiver is mounted to the stock. Advantageously, use of an intentionally and predetermined convex surface profile relieves manufacturing tolerance constraints in attempting to fabricate perfectly flat bearing surfaces on every pair of mating bearing surfaces between of the receiver and stock, as further explained herein. This eliminates re-machining to correct imperfectly flat bearing surfaces far achieving a tight fit between the receiver and stock.

According to one embodiment, a stock bedding system for a firearm includes a receiver having a front end configured for coupling to a firearm barrel, the receiver defining, a longitudinal axis and including a first pair of bearing surfaces, and a stock having a second pair of bearing surfaces configured and arranged in the stock for mating with the first pair bearing surfaces of the receiver. Each one of the second pair of bearing surfaces is positioned to engage a corresponding opposing one of the first pair of bearing surfaces when the receiver is mounted in the stock. At least one bearing surface of the receiver or stock has a convex shaped profile when viewed transverse to the longitudinal axis and is mutually engaged with its respective corresponding opposing bearing surface of the receiver or stock having a substantially flat shaped profile when the receiver is mounted in the stock.

In one embodiment, stock bedding system further includes a third pair of bearing surfaces disposed in the receiver and spaced axially apart from the first pair of bearing surfaces, and a fourth pair of bearing surfaces configured and arranged in the stock for mating with the third pair bearing, surfaces of the receiver. Each one of the fourth pair of bearing surfaces is positioned to engage a corresponding opposing one of the first pair of bearing surfaces when the receiver is mounted in the stock. At least one bearing surface of the third pair or the fourth pair has a convex shaped profile when viewed transverse to the longitudinal axis and is mutually engaged with its respective corresponding opposing bearing surface of the receiver or stock having a substantially flat shaped profile when the receiver is mounted in the stock.

According to another embodiment, a stock bedding system for a firearm includes a receiver having a front end configured for coupling to a firearm barrel, the receiver defining a longitudinal axis and a pair of opposing angled bearing surfaces, a stock having a bearing portion defining a longitudinally-extending channel configured for receiving at least part of the receiver therein, and a recoil pillar lug disposed in the channel and defining a pair of opposing angled bearing surfaces configured and arranged for mating with the pair of bearing surfaces of the receiver when the receiver is mounted to the stock. Each one of the bearing surfaces of the pillar lug engages a corresponding one of the bearing surfaces of the receiver. At least one of the bearing surfaces of the receiver or stock has a convex shaped profile and engages its corresponding respective bearing surface of the receiver or stock having a substantially flat shaped profile. In one embodiment, the bearing surfaces of the receiver are each disposed in a slot formed on opposing lateral sides of the receiver. The slots each define rearward and forward facing vertical thrust surfaces which are configured and arranged to axially engage corresponding forward and a rearward facing vertical thrust surfaces formed on the pillar lug. The vertical thrust surfaces operable to prevent longitudinal axial movement of the receiver with respect to the stock.

According to another embodiment, a stock bedding system for a firearm includes a receiver having a front end configured for coupling to a firearm barrel, the receiver defining a longitudinal axis, a front end, a rear end, a first lateral side having a portion including a first bearing surface, and a second lateral side having a portion including a second bearing surface. The stock bedding system further includes a stock having a bearing portion defining a longitudinally-extending channel configured for receiving at least part of the receiver therein, and a recoil pillar lug mounted in the stock. The pillar lug defines a third bearing surface engaging the first bearing surface and a fourth bearing surface engaging the second bearing surface when the receiver is mounted in the stock. One of the first or third bearing surfaces has a substantially non-planar profile and the remaining one of the first or third bearing surfaces has a substantially planar profile.

A method for mounting a receiver on a stock of a firearm is disclosed. The method includes: positioning a receiver of a firearm defining a longitudinal axis on a stock; engaging a first convex shaped bearing surface disposed near a first lateral side of the stock with a mating second substantially flat bearing surface disposed near the first lateral side of the stock; engaging a third substantially flat bearing surface disposed near an opposite second lateral side of the stock with another mating fourth substantially flat bearing surface; drawing the receiver downwards into stock; tightening the engagement between the first convex shaped bearing surface and the mating second substantially flat bearing surface; creating a twisting force on the receiver that acts in a direction transverse to the longitudinal axis via interaction between the first convex shaped bearing surface and the mating second substantially flat bearing surface; and rotating the receiver from the first lateral side of the stock towards the opposite second lateral of the stock while maintaining engagement between the first convex shaped bearing surface and the mating second substantially flat bearing surface, wherein engagement between the third substantially flat bearing surface disposed near the opposite second lateral side of the stock and the mating fourth substantially flat bearing surface is tightened. In one embodiment, the first convex shaped bearing surface maintains its convex shape during the tightening step.

BRIEF DESCRIPTION OF THE DRAWINGS

The features of the exemplary embodiments will be described with reference to the following drawings where like elements are labeled similarly, and in which:

Any reference herein to a single figure (e.g. FIG. 5) including multiple subpart figures (e.g. FIG. 5A, etc.) shall be construed as a reference to all subpart figures in that group unless specifically noted otherwise

DESCRIPTION OF EXEMPLARY EMBODIMENTS

Figure 1:
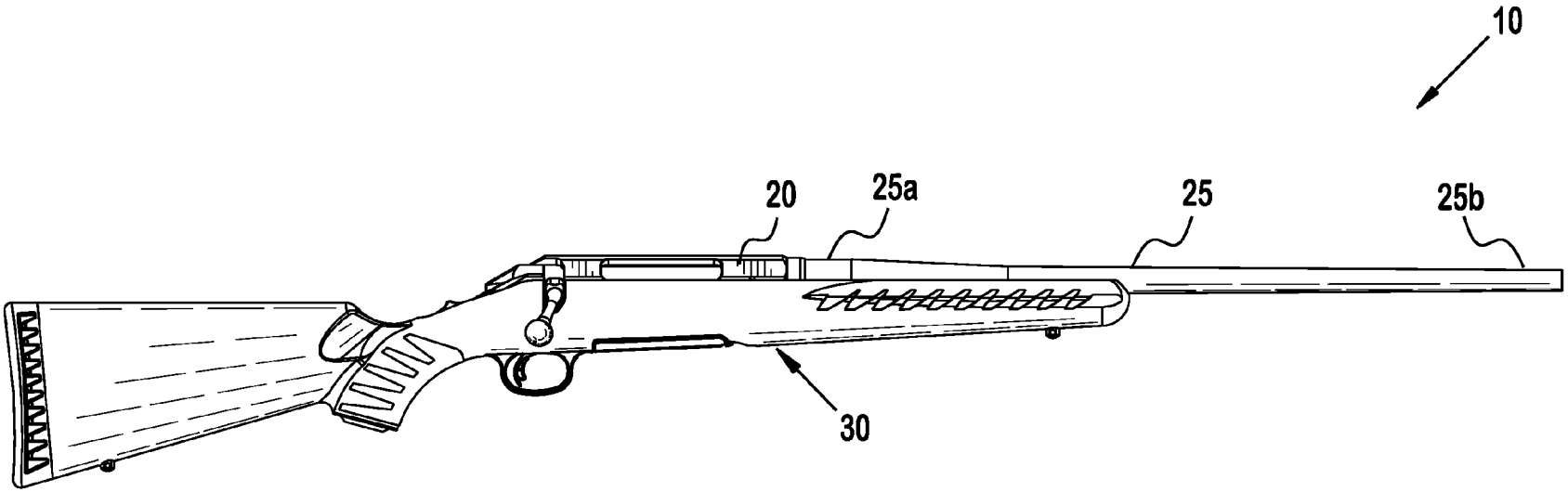
FIG. 1 shows one embodiment of a firearm with stock bedding system according to the present disclosure in the form of a bolt action rifle.

The features and benefits of the invention are illustrated and described herein by reference to exemplary embodiments. This description of exemplary embodiments is intended to be read in connection with the accompanying drawings, which are to be considered part of the entire written description, in the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be hunted to such exemplary embodiments illustrating some possible non-limiting combination of features that may exist alone or in other combinations of features.

An exemplary embodiment will now be described for convenience with reference and without limitation to bolt action rifle 10 shown in FIGS. 1 and 2. Rifle 10 includes an elongated and generally tubular hollow receiver 20 defining a longitudinal axis LA for rifle 10 and a barrel 25 mounted thereto having an open forward muzzle end 25*b* and externally open chamber 25*a* formed at a rearward end that is configured for holding a cartridge. Barrel 25 defines an internal axial bore between muzzle end 25*b* and chamber 25*a* through which a bullet or slug passes when the rifle 10 is discharged. Receiver 20 is fixedly and rigidly mounted in a stock 30 via a stock bedding system as disclosed and further described herein.

Figure 2:
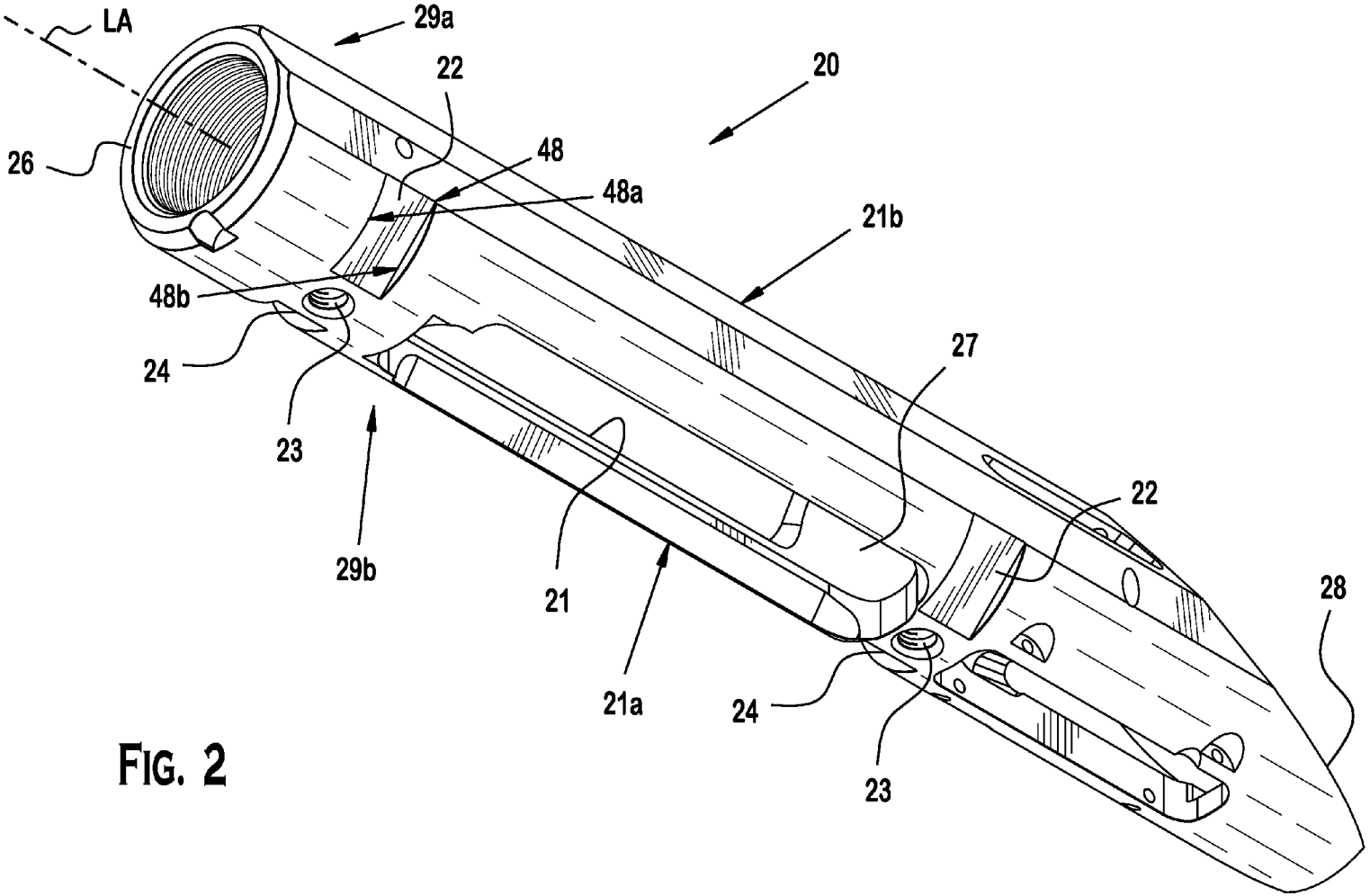
FIG. 2 is a bottom perspective view of the receiver in the rifle of FIG. 1.

Referring to FIG. 2, receiver 20 includes an elongated body having an open threaded front end 26 for mounting a rear threaded end of barrel 25 thereto, a rear end 28, a top 29*a*, a bottom 29*b*, and an elongated bottom opening 21 for communicating with a corresponding elongated opening 33 in stock 30 (see FIG. 3); both openings 21, 33 in turn communicate with a conventional rifle magazine (not shown) mounted below the receiver and stock (see FIG. 1) for uploading new cartridges into the barrel chamber. Receiver 20 defines an elongated internal passageway 27 (see also FIG. 10) that communicates with the chamber 25*a* and bore of barrel 25, and slidably receives a conventional manually actuated rifle bolt (not shown) for forming a closeable and openable breech as will be well known to those skilled in the art.

Figure 6:
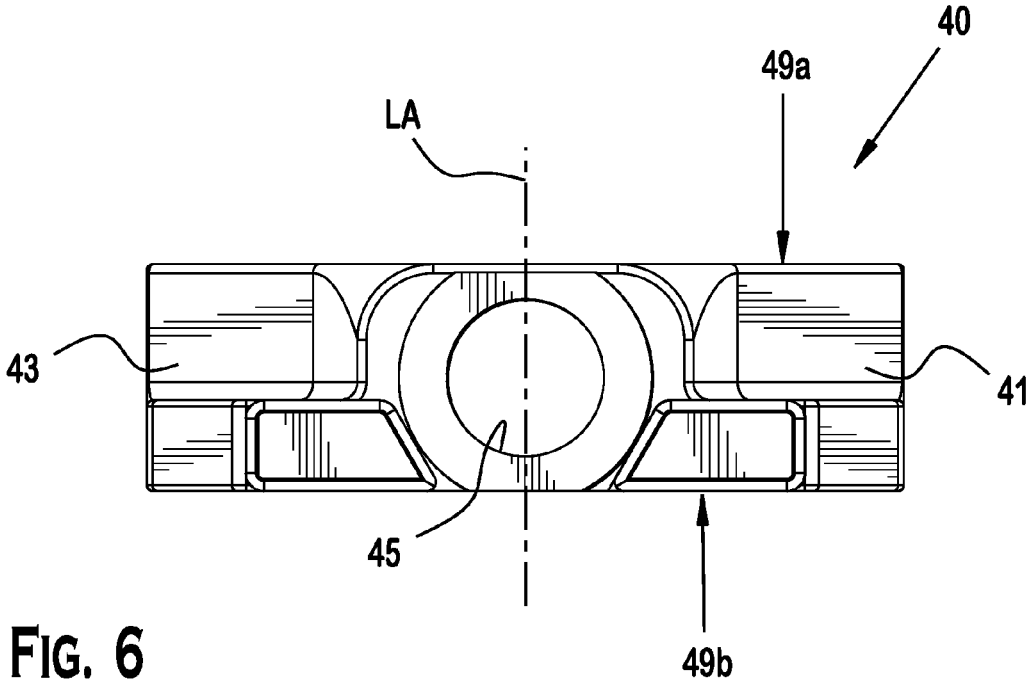
FIG. 6 is a bottom view thereof.
Figure 7:
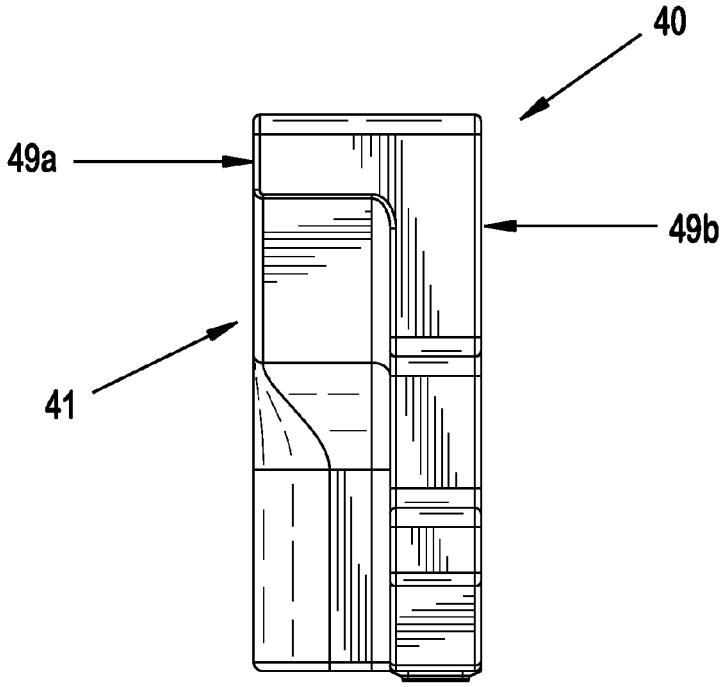
FIG. 7 is a side elevation view thereof.

As part of the stock bedding system disclosed herein, receiver 20 further includes at least one, but preferably at least two pans of angled bearing surfaces 22, 24 as shown in FIG. 2. In one embodiment, each pair of bearing surfaces 22, 24 are axially spaced apart along, the longitudinal axis LA as shown to securely mount the front and rear portions of the receiver 20 to the stock 30 at two axial locations for a stable mounting. Bearing surfaces 22, 24 in one embodiment are preferably planar or flat and extend from a point proximate to bottom 29*b* of receiver 20 upwards at least partially along opposing lateral sides 21*a* and 21*b* of the receiver (see also FIG. 9) at each axial location. The bearing surfaces 22, 24 are therefore disposed proximate to each other and define a V-shaped or wedge-shaped bearing portion on receiver 20 configured to engage the opposing V-shaped or wedge-shaped bearing portion in stock 30 defined by bearing surfaces 42, 44 of pillar lugs 40 (see FIGS. 5-7). In one embodiment, as shown in FIGS. 9 and 10, bearing surfaces 22 and 24 on receiver 20 are disposed in two opposing lower quadrants of the receiver (i.e. 3-6 o'clock and 6-9 o'clock positions).

Bearing surfaces 22, 24 may be recessed into receiver 20 as shown in FIG. 2 which forms slots 48 that assist in properly locating and positioning the action and receiver onto recoil pillar lugs 40 during the mounting process. Slots 48 are configured to complement the shape of and receive pillar lugs 40 therein. Each slot 48 defines a rearward facing and a forward facing vertical thrust surface 48*a*, 48*b* which is configured and arranged to abuttingly engage a corresponding forward facing and a rearward facing vertical thrust surface 49*a*, 49*b* respectively formed on pillar lugs 40 (see FIG. 3) to prevent longitudinal axial movement of the receiver 20 when mounted in stock 30. In the embodiment shown in FIG. 2, there are four slots 48 in receiver 20 with each one of the slots being associated with one of the four bearing surfaces 22, 24. In a similar manner, there is a pair of thrust surfaces 48*a*, 48*b* associated with each one of the slots and bearing surfaces 22, 24. In the embodiment shown in FIGS. 3-4, there are four thrust surfaces 49*a*, 49*b* formed on each pillar lug 40 for mating with corresponding thrust surfaces 48*a*, 48*b* in each slot 48 of the receiver 30.

Figure 9:
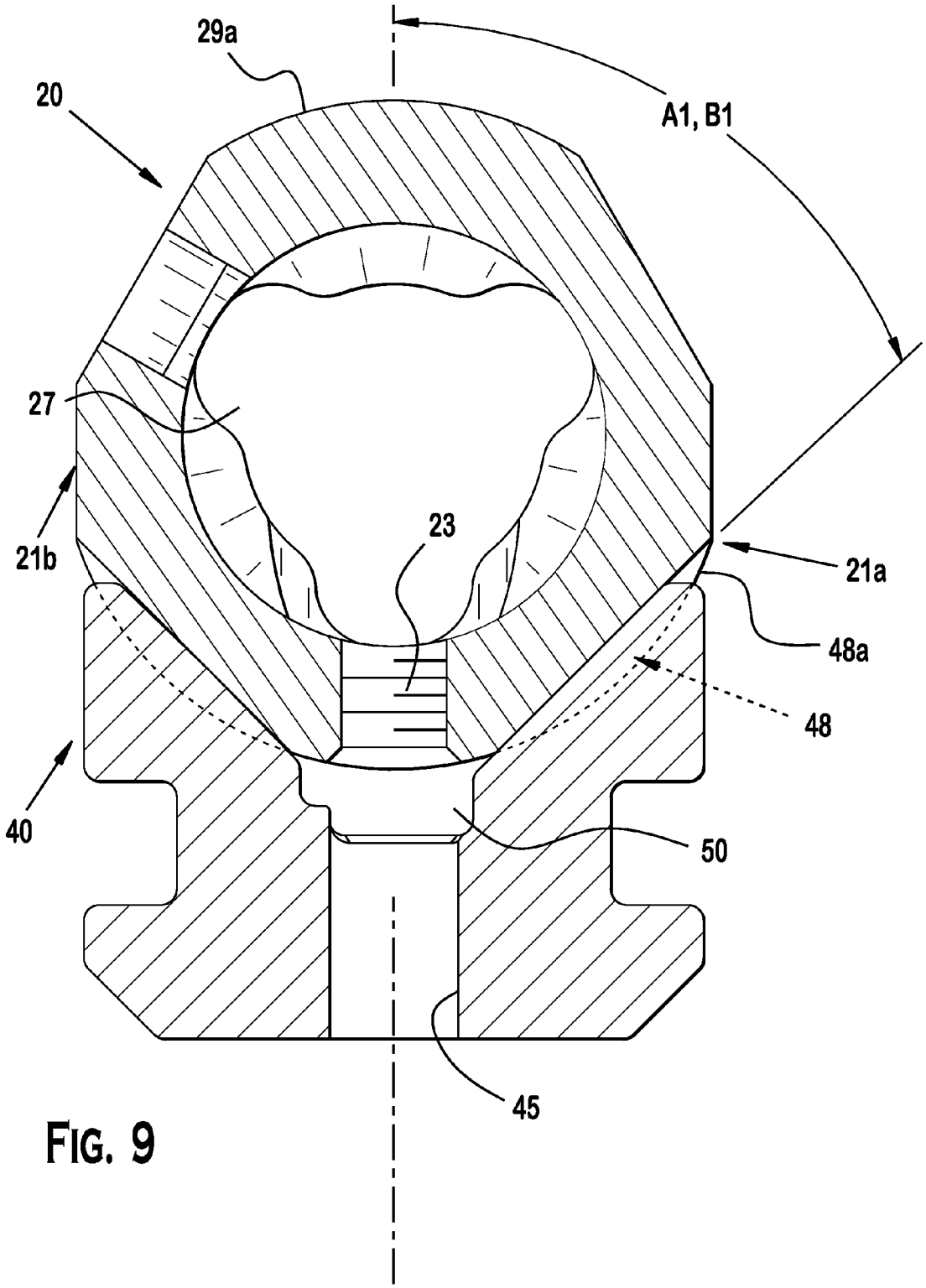
FIG. 9 is a rear cross-sectional view taken through the pillar lug and receiver of FIG. 8.
Figure 10:
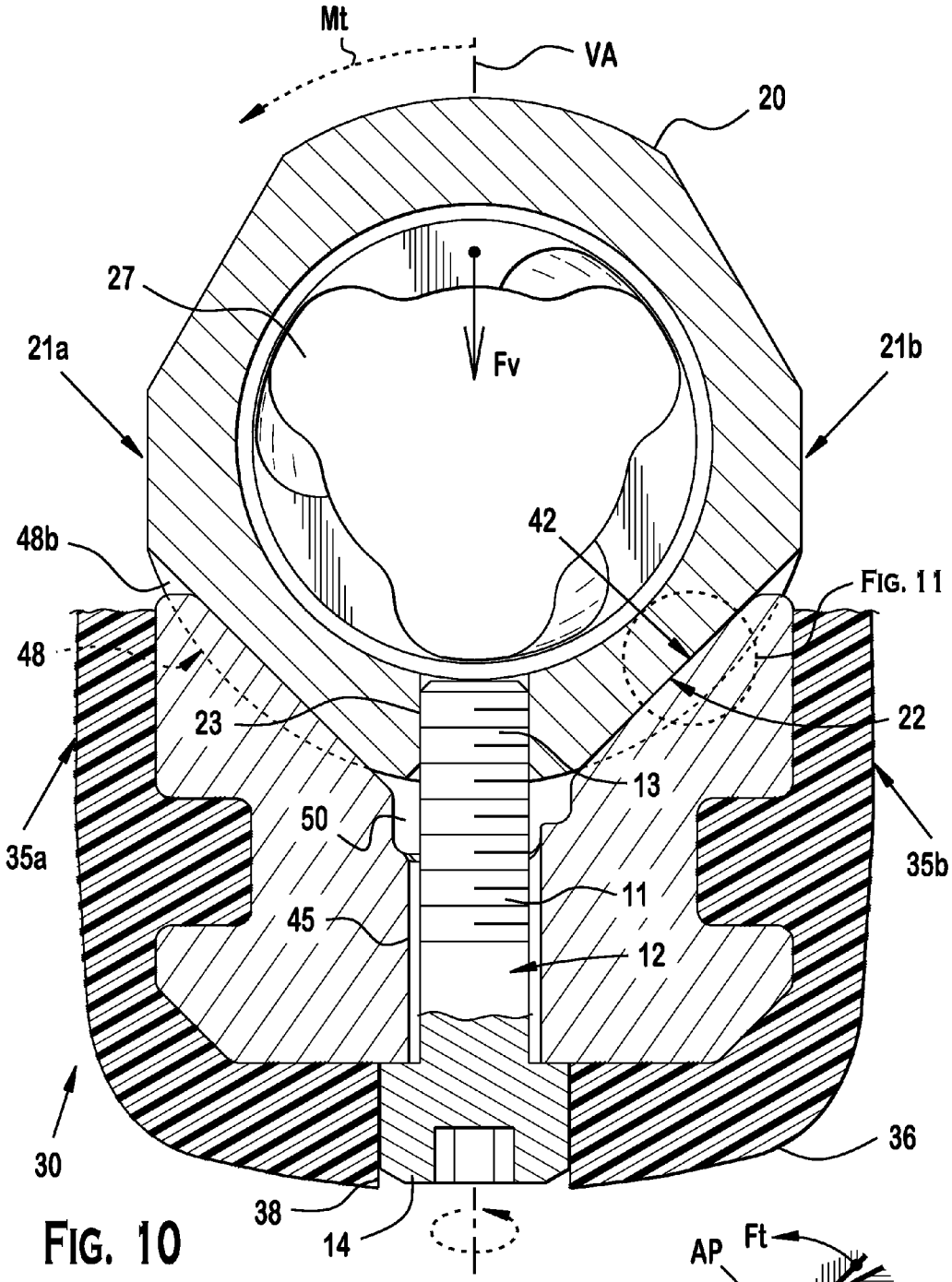
FIG. 10 is a front cross-sectional view taken through the pillar lug and receiver showing the two components coupled via, a mounting fastener.

At least one, but preferably at least two threaded mounting holes 23 are disposed in the bottom 29*b* of receiver 20 for threadably receiving mounting fasteners 12 to secure the receiver to the stock 30 (see also FIGS. 9 and 10). In one embodiment, a threaded hole 23 is disposed between each pair of bearing surfaces 22, 24 as best shown in FIG. 2 so that tightening the mounting fastener 12 tightly pulls the upper bearing surfaces 22, 24 downwards into engagement with corresponding lower bearing surfaces 42, 44 disposed in the stock 30, as limber described herein.

Figure 12:
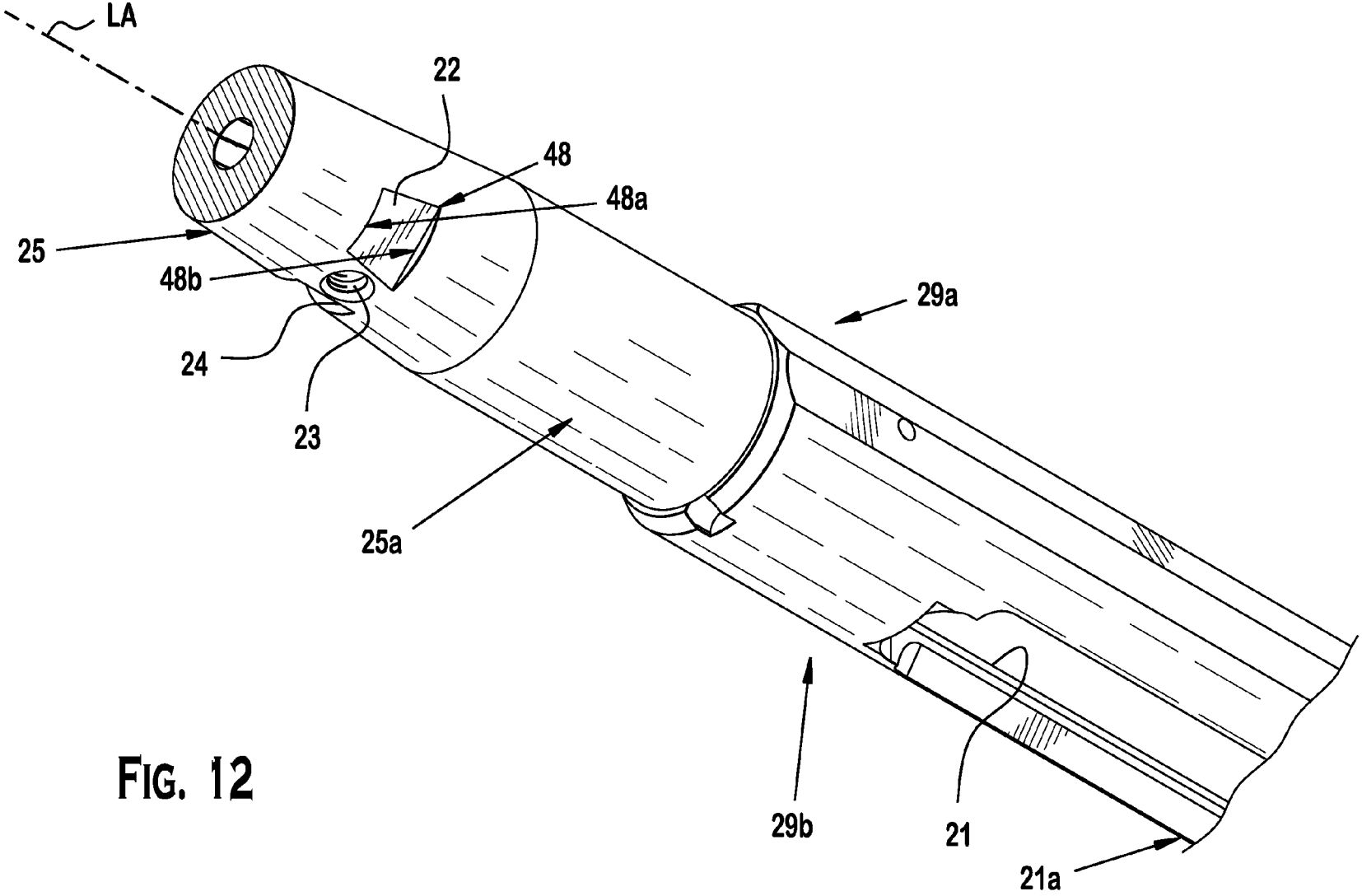
FIG. 12 is a bottom perspective view of the barrel-receiver assembly of the rifle of FIG. 1 showing an alternative arrangement of bearing surfaces disposed on the barrel.

In some alternate embodiments of rifle 10, as shown in FIG. 12, a pair of the angled hearing surfaces 22, 24 may be located elsewhere on the barrel-receiver assembly 25/20 rather than on the receiver. Bearing surfaces 22, 24 and slots 48 may be disposed on the bottom of the barrel 25 and/or chamber 25*a*. In the non-limiting embodiment shown, the bearing surfaces 22, 24 are disposed on the bottom of the barrel forward of the chamber. The mating pair of bearing surfaces 42, 44 which may be formed on pillar lug 40 may then be positioned and located in front portion 34 of stock 30 (see FIG. 3) for engaging, bearing surfaces 22, 24 on barrel 25 when the receiver 20 is mounted to the stock. A second pair of bearing surfaces 22, 24 axially spaced rearward of the bearing surfaces 22, 24 formed on the barrel shown in FIG. 12 may be located on the receiver in the manner described and shown in FIG. 2. Alternatively, in some embodiments, a single pair of bearing surfaces 22, 24 may be provided on the barrel 25 and/or chamber 25*a* alone without any additional pairs of bearing surfaces 22, 24 on either the barrel-receiver assembly 25/20.

Figure 3:
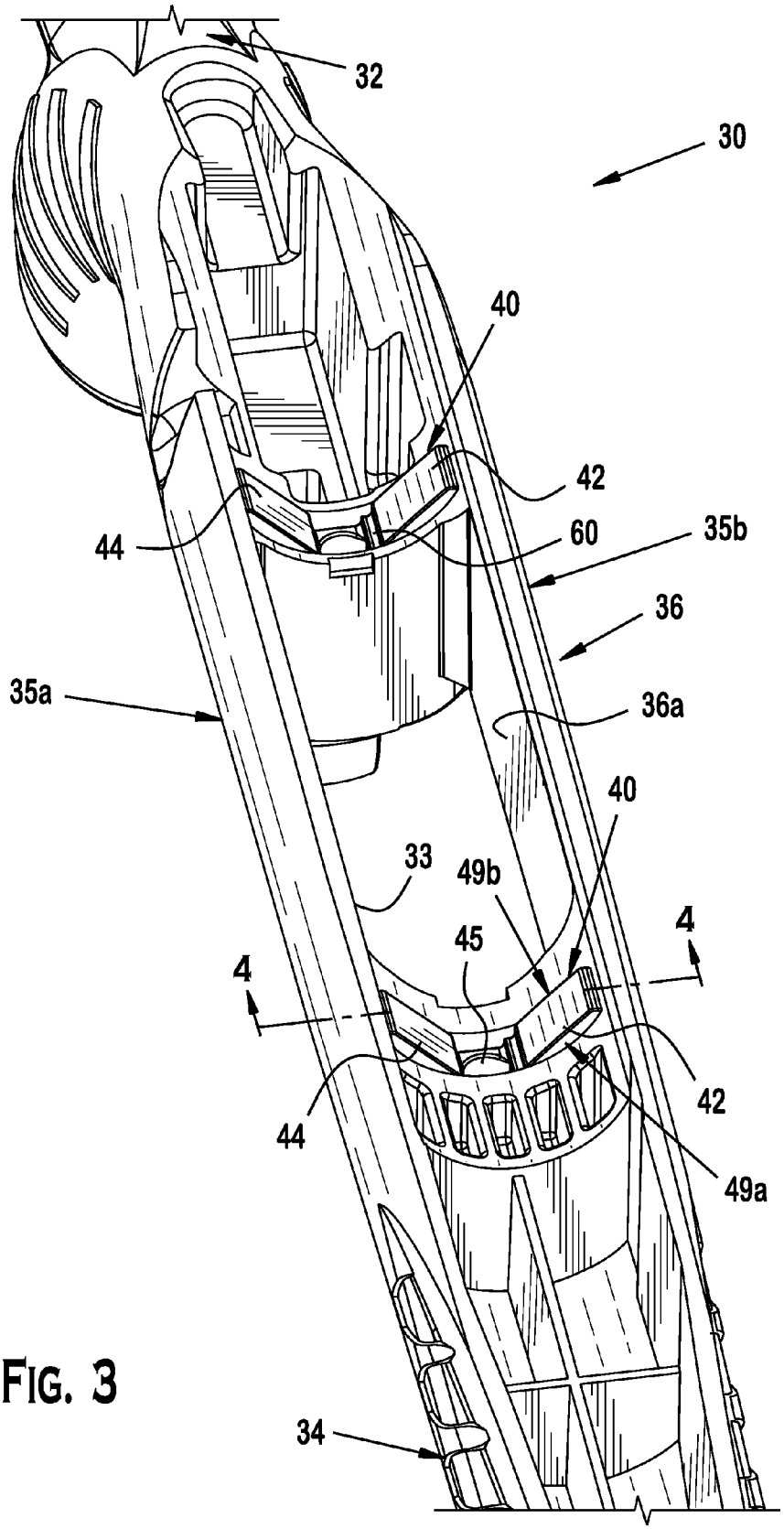
FIG. 3 is a top perspective view of the stock in the rifle of FIG. 1 with receiver and other components dismounted.

FIG. 3 depicts a close-up view of stock 30 without the receiver 20 positioned on the stock for clarity. In some embodiments, stock 30 may be made of natural materials such as wood or synthetic materials such as polymer which may be molded or otherwise formed using suitable methods known in the art. Stock 30 includes a rear butt stock portion 32, a front portion 34, and an intermediate mounting portion 36 disposed therebetween. Mounting portion 36 is configured and arranged for receiving and mounting the receiver 20 thereto (see also FIG. 3). Accordingly, in one embodiment, mounting portion 36 includes a longitudinally-extending channel configured to receive the bottom 29*b* portion of receiver 20 at least partially therein. Stock 30 further includes Stock 30 may include a plurality of recesses, chambers, and openings as shown for various purposes.

Figure 4:
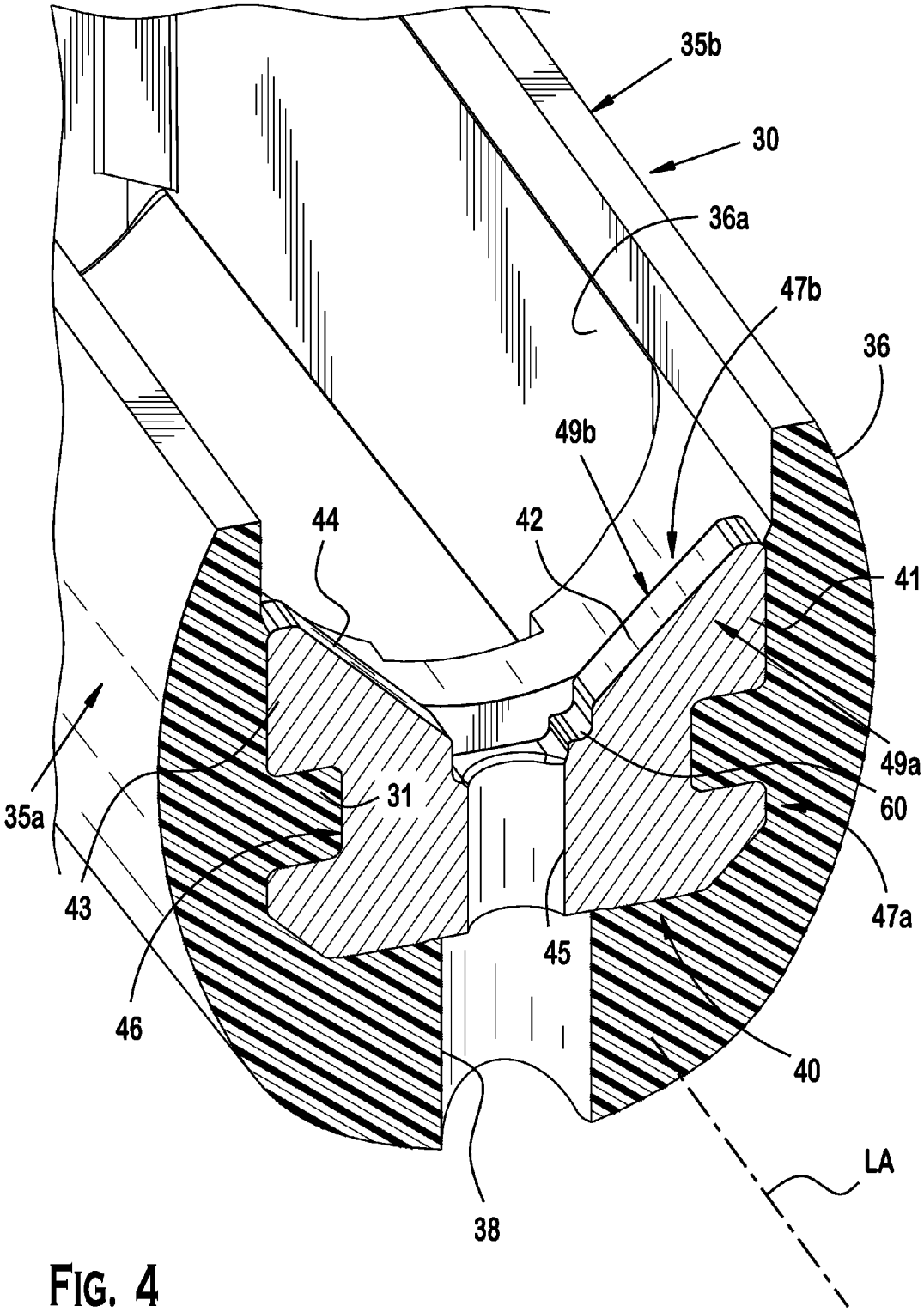
FIG. 4 is a cross-sectional perspective view taken along line 4-4 in FIG. 3 through a recoil pillar lug.

Referring to FIGS. 2-4, stock 30 includes a stock bedding system, which in some embodiments includes at least one pair, and in other embodiments at least two pairs of opposing bearing surfaces 42, 44 for mating with corresponding bearing surfaces 22, 24 disposed on the receiver 20. Bearing surfaces 42, 44 are rigidly mounted to mounting portion 36 of stock 30 in channel 36*a* to prevent longitudinal, transverse, or twisting/torsional movement of the bearing surfaces with respect to the stock under the recoil forces generated when the rifle 10 is fired.

Referring to FIGS. 2 and 3, bearing surfaces 22 positioned closest to left lateral side 21*b* of receiver 20 and bearing surfaces 42 in the stock 30 positioned closest to left lateral side 35*b* define "left" or "left side" bearing surfaces with respect to the longitudinal axis LA when viewed from the perspective of a user holding the butt stock portion of rifle 10. Similarly, bearing surfaces 24 positioned closest to right lateral side 21*a* of receiver 20 and bearing surfaces 44 in stock 30 positioned closest to right lateral side 35*a* define "right" or "right side" bearing surfaces with respect to longitudinal axis LA when viewed from the same perspective. The right and left side rifle designations will be referenced for convenience in further describing the stock bedding system disclosed herein.

In one embodiment, referring to FIGS. 3-10, bearing surfaces 42, 44 may be formed on one or more recoil pillar lugs 40 that are rigidly anchored in stock 30. The pillar lugs 40 are operable to anchor receiver 20 to stock 30. Pillar lugs 40 may be considered generally butterfly shaped in overall configuration in some embodiments including a right lateral wing section 41 and a left lateral wing section 43 disposed on opposite sides of a central mounting aperture 45 that may extend completely through the lug as shown. In one embodiment, two pillar lugs 40 are provided as shown. Pillar lugs 40 may be axially spaced apart as shown when mounted in stock 30 (see FIG. 3) and are axially positioned to match the axial position of a corresponding mating bearing surfaces 22, 24 on receiver 30.

Mounting aperture 45 may be circular in cross section and defines a vertical central axis of the pillar in 40. In one embodiment, aperture 45 may communicate with and be concentrically aligned with a vertical mounting hole 38 formed in stock 30. Aperture 45 and hole 38 are configured and dimensioned to receiver a mounting fastener 12 (see FIG. 10) for anchoring the receiver 20 to stack 30, as further described herein. In one embodiment, aperture 45 and hole 38 may be unthreaded.

As best shown in FIG. 10, mounting fastener 12 may include a shank 11, an enlarged head 14 on one end of the shank, and a threaded end 13 on the opposite end of the shank. In some embodiments, shank 11 may be plain and unthreaded except for threaded end 13. Threaded end 13 may be reduced in diameter in some embodiments in relation to the diameter of shank 11. Head 14 may be configured as any suitable and commercially available fastener head for engagement by a tool operable to tighten or loosen the fastener 12.

Referring to FIGS. 3-10, pillar lug 40 defines a lower anchoring portion 47*a* and an upper wedge-shaped bearing portion 47*b* comprised of inward facing bearing surfaces 42 and 44 which may be formed on an upper part of each wing section 41 and 43, respectively. In some embodiments, anchoring portion 47*a* may include at least one lateral recess 46 that receives a tab 31 formed on stock 30 for anchoring and interlocking the pillar lug 40 to the stock 30. In one embodiment, one recess 46 is provided in each lateral side of pillar lug 40 on the right and left wing sections 41, 43. In one embodiment, where stock 30 is formed of a synthetic moldable polymeric material, pillar lugs 40 may be co-molded to the stock via a suitable co-molding process which is well known to those skilled in the art. Tab 31 formed in the intermediate mounting portion 36 may therefore be an integral part of the unitary monolithic stock when the stock is molded. The pillar lugs are first placed and positioned in the stock mold (containing a negative impression of the stock), after which the polymeric material is injected or flowed into the mold and enters the lateral recesses 46 of the pillar lugs 40. The recesses 46 are filled with the polymeric stock material and the lugs 40 are therefore securely anchored within the stock 30 when the material hardens. Recesses 46 and tabs 31 retain the pillar lugs in the stock (see, e.g. FIG. 4).

In other embodiments contemplated where a natural stock material such as wood may be used, the pillar lugs 40 may be anchored to the wooden stock via suitable threaded fasteners that threadably engage the lugs, or another suitable mechanical coupling means (e.g. epoxy or adhesives) commonly used in the art for joining two components together.

With continuing reference to FIGS. 3-10, hearing surfaces 42, 44 disposed on upper wedge-shaped bearing portion 47*b* may face laterally inwards towards the longitudinal axis LA of the rifle 10 to provide a tightening, positioning action when mated with corresponding bearing surfaces 22, 24 formed on receiver 20 (see FIG. 2) which preferably face in an opposite laterally outwards direction away from longitudinal axis LA. In one embodiment, therefore, bearing sin faces 42, 44 are angled surfaces which are disposed at an angle A1 to vertical axis VA (and lateral sides 35*a*, 35*b* of stock 30). Any suitable angle preferably greater than 0 degrees and less than 90 degrees measured from the vertical axis VA may be used. In one illustrative embodiment, without limitation, angle A1 may be about 45 degrees as a representative example. Bearing, surfaces 22, 24 on receiver 20 accordingly may have the same angle B1 with respect to the vertical axis VA (and lateral sides 21*a*, 21*b*) as shown in FIG. 9 as angle A1 to mate properly with bearing surfaces 42, 44 so that the bearing surfaces abuttingly engage each other to provide as flat surface contact therebetween as possible (within manufacturing, tolerances) to securely seat the receiver 20 against the pillar lugs 40.

Given actual machining and fabrication tolerances, however, it is sometimes difficult in practice to actually achieve perfectly planar or flat surface contact between more than two opposing, and mating flat machined surfaces (e.g. bearing surfaces 22, 24 on receiver 20 and surfaces 42, 44 on stock 30) with the high degree of precision necessary for secure mutual engagement that is free of movement or vibration when discharging the firearm. Even slight unevenness in the engagement between the mutually mating and abutting surfaces may result in undesirable movement or rocking of the stock bedding system when shooting, which can compromise point of impact and accuracy of the firearm. Because there are four mating bearing surfaces associated with each pillar lug 40 and receiver 20 (e.g. surfaces 42, 44 and 22, 24), achieving flat-to-flat surface contact between one pair of mating bearing surfaces on one lateral side of the stock (e.g. left lateral side 35*b* surfaces 22 and 42) sometimes compromises the ability to achieve a flat-to-flat contact between the remaining opposing mating bearing surfaces on the opposite lateral side of the stock (e.g. right lateral side 35*a* surfaces 24 and 44). This sometimes may result in extra and time-consuming re-machining of the bearing surfaces over one or more iterations to achieve the desired tight fit between the receiver and stock.

The inventors have discovered that contrary to the conventional wisdom in the art seeking flat-to-flat surface contact between all mating surfaces in stock bedding systems, intentionally forming a predetermined slightly radiused convex surface in the transverse direction to the longitudinal axis LA (i.e. perpendicular to axis LA) on one of the opposing mating pairs of bearing surfaces advantageously overcomes the foregoing machining tolerance problems and advantageously enhances a secure engagement between bearing surfaces 22, 24 on receiver 20 and corresponding bearing surfaces 42, 44 on the pillar lugs 40.

Figure 5:
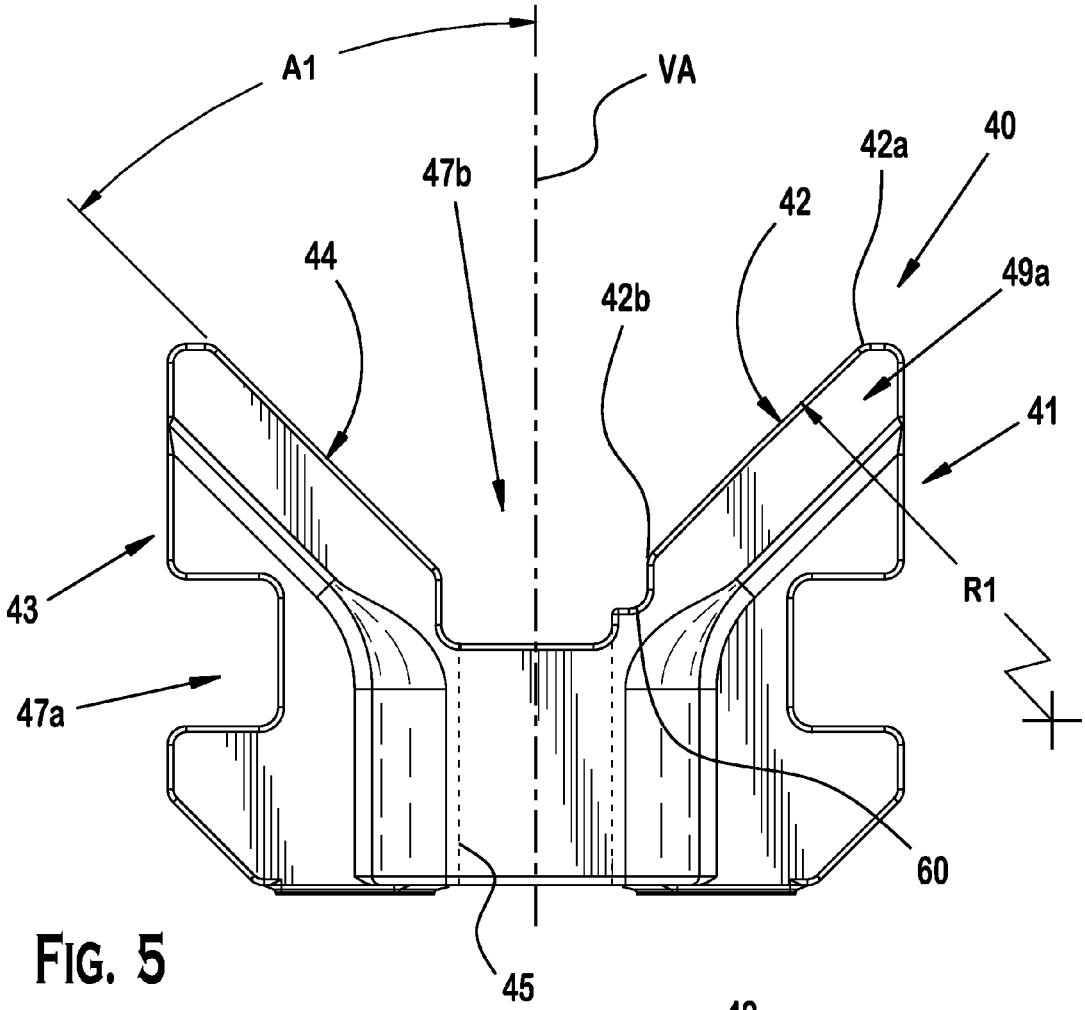
FIG. 5 is a front view of the recoil pillar lug of FIGS. 3 and 4.
Figure 5A:
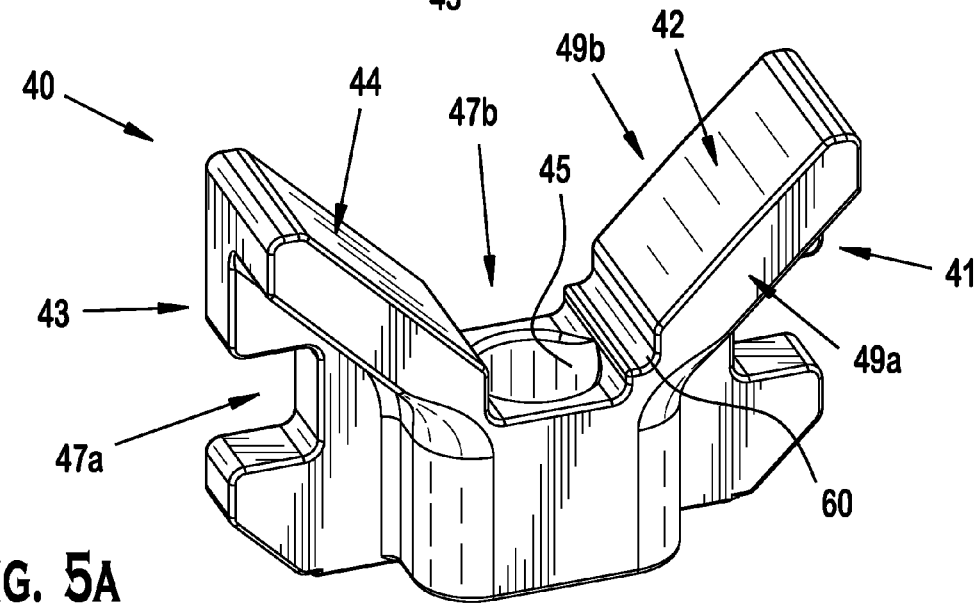
FIG. 5A is perspective view thereof.
Figure 11:
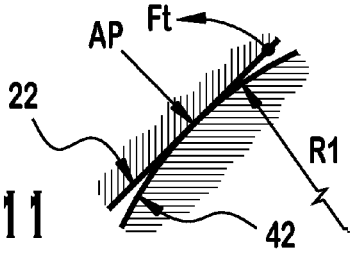
FIG. 11 is an enlarged diagrammatic close-up view taken from FIG. 10 showing linear contact between bearing surfaces on the receiver and pillar lug.

Accordingly, in one embodiment with reference to FIGS. 5 and 11, one of the bearing surfaces on pillar lug 40 such as bearing surface 42 has a transverse convex surface profile with a radius R1 when viewed axially along the longitudinal axis LA (as shown in the views of these referenced figures). The radios R1 may be relatively small and need only be sufficient to cause the receiver 20 to slightly roll or twist laterally in an opposite angular direction away from bearing surface 42 and towards the opposite bearing surface 44 on the opposite side of the pillar lug, in one illustrative embodiment, without limitation, radius R1 may be about 7.5 inches.

As shown in FIG. 5, radius R1 and the convex shaped bearing surface 42 in a preferred embodiment extends laterally and vertically over a majority of the bearing surface area defined by bearing surface 42 which extends from a top linear edge 42*a* of the pillar lug 40 to a bottom linear edge 42*b* of the pillar lug. In one embodiment, the convex curvature of bearing surface 42 extends over substantially the entire surface area of bearing surface 42 between the top and bottom linear edges 42*a*, 42*b* of the pillar lug 40 as best shown in FIGS. 9 and 10. Accordingly, a very gradual and slight radius and arcuately curved surface is created over the entire surface of bearing surface 42.

To achieve the desired rolling action of receiver 20 when mounting the receiver in stock 30, in a preferred embodiment, convex shaped surface 42 is farther structured and formed of a substantially inelastic material having a suitable thickness (e.g. metal) which does not substantially plastically and permanently deform when mating bearing surface 22 of receiver 20 is compressed against surface 42 when mounting fastener 12 is fully tightened. In lieu of deforming or crushing convex bearing surface 42, the receiver 20 will cause receiver 20 to roll towards the opposing lateral bearing surfaces 41 on the pillar lug 40 as described further herein.

In the embodiment shown in FIGS. 3-11, each of the two pillar lugs 40 includes a bearing surface 42 having a transverse convex surface profile. Preferably, the bearing surface 42 is disposed on the same wing 41 or 43 of each pillar lug 40 proximate to one lateral side stock 30 so that the receiver 20 is slightly rolled in the same angular direction (i.e. clockwise or counter-clockwise) when viewed along longitudinal axis LA. It should be noted that the contact between convex bearing surface 42 and mating bearing surface 77 of receiver 20 is approximately linear in nature in an axial direction rather than flat-on-flat contact which results from the mating of the opposing pillar lug flat bearing surfaces 44 to mating flat bearing surfaces 24 on receiver 30.

In other embodiments contemplated, the convex bearing surface may be provided instead on one of the bearing surfaces 22 or 24 on the receiver and both bearing surfaces 42, 44 on pillar lugs 40 may be flat in a similar manner to that described above.

To facilitate proper placement and orientation of the two pillar lugs 40 into the injection mold when forming stock 30 from polymer in some embodiments, a notch 60 may be provided as shown in FIGS. 3 and 5 to designate the convex bearing surface 42. This ensures that the convex bearing surface 42 is located on the same lateral side of the stock 30 as best shown in FIG. 3 since it is preferred that each convex bearing surface be on the same side to roll the receiver 20 in an opposing lateral angular direction when the receiver is mounted to the stock. It will be appreciated therefore that the notch 60 is for molding purposes only.

The pillar lugs 40 may be made of any suitable metallic material commonly used in firearm manufacture which is substantially inelastic and not deformable to a degree that would prevent the desired rolling motion of receiver 20 when mounting fastener 12 is tightened during mounting the receiver to the stock 30. In some embodiments, for example without limitation, the pillar lugs 40 may be made of steel, aluminum, or titanium. In one embodiment, pillar lugs 40 may be made of stainless steel. Receiver 20 may be made of any suitable metallic, material commonly used in firearm manufacture. In some embodiments, for example without limitation, receiver 20 may be made of steel, aluminum, or titanium. Preferably, bearing surfaces 42, 44 are formed as integral unitary structural parts of the right and left lateral wing sections 41, 43 of the pillar lugs having a suitable thickness which in conjunction with the material selected prevent plastic deformation of the bearing surfaces.

An exemplary method for mounting a receiver 20 in a stock 30 of a rifle 10 according to embodiments of the stock bedding system disclosed herein will now be described, in this embodiment, a synthetic polymeric stock 30 is provided as shown in FIGS. 3 and 4 with pillar lugs 40 already co-molded or otherwise mounted therein and ready to receive the receiver 20. Preferably, the non-planar and convex-shaped bearing surfaces 42 are each located on the same lateral side of the stock as shown and the generally planar or flat bearing surfaces 44 therefore are located on the same opposite lateral side. Notches 60 aid to ensure that the recoil pillar lugs 40 are placed in the correct orientation in the injection mold when molding the receiver. Receiver 30 is also provided as shown in FIG. 2 with substantially planar or flat bearing surfaces 22, 24 and threaded mounting holes 23.

Figure 8:
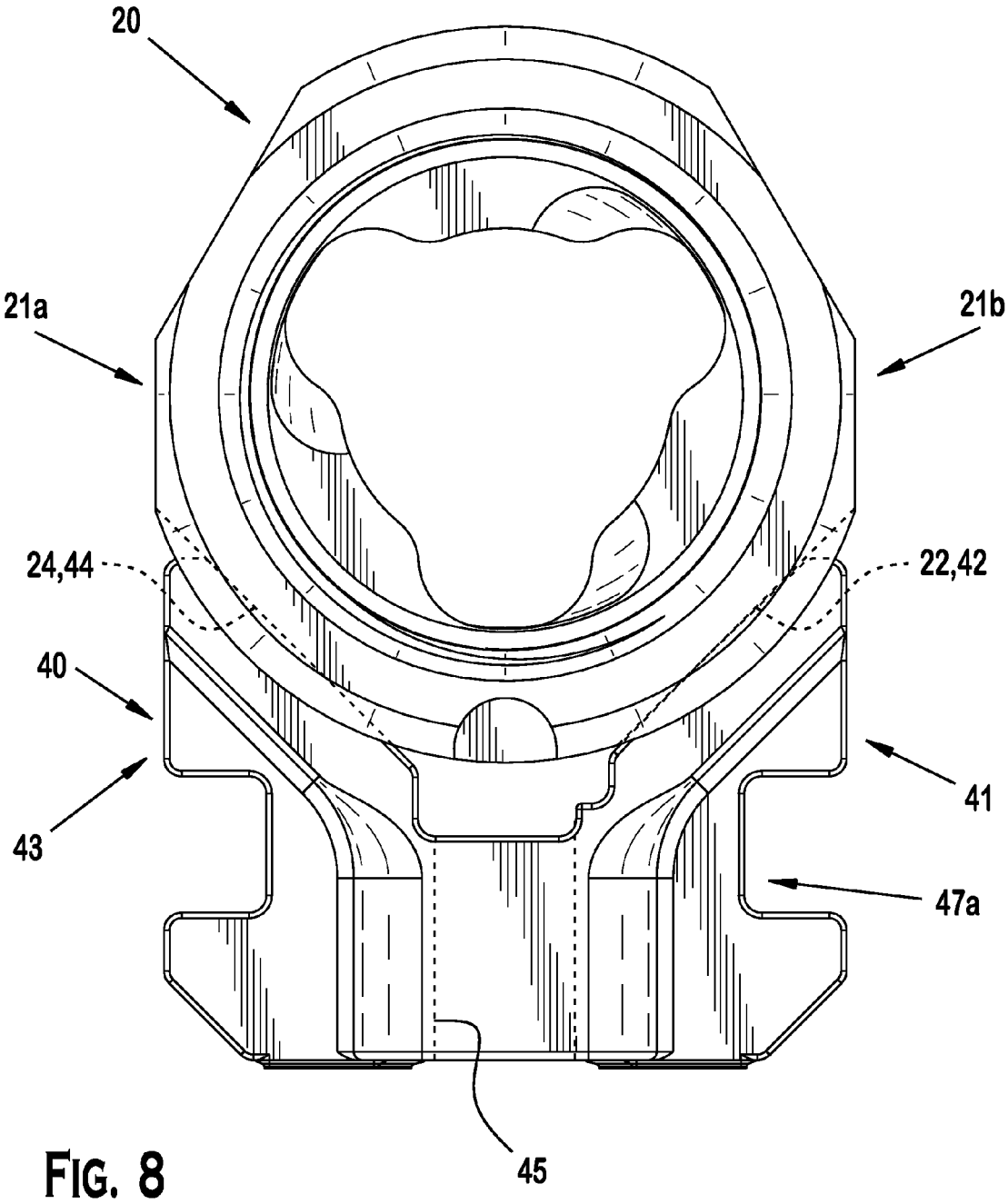
FIG. 8 is a front view of the receiver positioned on one of the pillar lugs of FIG. 3 shown disembodied from the stock.

The receiver 20 is next positioned in mounting portion 36 of stock 30 and onto pillar lugs 40, as shown in FIGS. 8 and 9 (stock not shown for clarity in these figures). Bearing surfaces 22, 24 are located and loosely abutted and engaged against bearing surfaces 42, 44 on pillar lugs 40. Since bearing surfaces 22, 24 are recessed into receiver 20 and form the corresponding slots 48 therein as already described (see also FIG. 2), proper placement and alignment of these bearing surfaces 22, 24 with mating bearing surfaces 42, 44 is ensured. A gap 50 as shown in FIGS. 9 and 10 is provided between the bottom 29*b* of receiver 20 and the part of anchoring portion 47*a* of the pillar lug 40 having mounting aperture 45 to further ensure that the receiver does not bottom out against the pillar lug when mounting fastener 12 is tightened before the mating bearing surfaces 22, 24, 42, and 44 have become fully engaged and reach their final mounting and operating positions. The desired engagement between receiver 20 and stock 30 preferably occurs between bearing surfaces 22, 24, 42, and 44 alone in one embodiment which meshing bearing surfaces are spaced vertically apart from mounting aperture 45.

With receiver 20 now positioned on stock 30 and pillar lugs 40, a mounting fastener 12 is then inserted upwards through each mounting hole 38 formed in stock 30, through mounting aperture 45 in pillar lug 40, and finally in turn into threaded mounting hole 23 in receiver 20 as shown in FIG. 10. These mounting holes and aperture are all concentrically aligned when the receiver is positioned in the stock. Each mounting fastener 12 is then rotated or turned using a suitable tool applied to the fastener head 14 to threadably engage threaded end 13 of the fastener with threaded hole 23 in the receiver.

As mounting fastener 12 is tightened, the receiver 20 is increasingly drawn downwards into stock 30 by vertical force Fv, as shown in FIG. 10. Bearing surfaces 22, 24 are concomitantly drawn into tighter and tighter contact and engagement with bearing surfaces 42, 44 of the pillar lugs 40 by force Fv. Engagement between convex shaped bearing surface 42 of stock 30 and substantially flat bearing surface 22 of receiver is accordingly tightened and increased.

As fastener 12 is further tightened, abutting engagement between the flat or planar bearing surface 22 on receiver 20 with the apex. AP of the non-planar convex bearing surface 42 on pillar lug 40 causes the receiver to roll and rotate counterclockwise laterally as viewed in FIG. 10) in a transverse direction to longitudinal axis LA and vertical axis VA from left lateral side 35*b* of stock 30 towards right lateral side 35*a* (see dashed directional arrow) and the already lightly engaged opposite bearing, surfaces 24, 44 on the right lateral side (both of which are both flat or planar in transverse contour and profile). It should be note that the receiver 20 rolls and rotates from the lateral side 35*b* of the stock towards the opposite lateral side 35*a* while maintaining engagement between convex shaped bearing surface 42 and substantially flat bearing surface 22. Engagement of the convex shape or profile of bearing surface 42 having a radius R1 with apex AP with mating flat or planar bearing surface 24 imparts a rotational or twisting moment Mt and force Ft onto the receiver about longitudinal axis LA as mounting fastener 12 is tightened (see FIG. 11 shows a closeup and intentionally exaggerated view of surface contact taken from FIG. 10 to better illustrate the operating principle involved). This twisting force Ft and moment Mt results in better positioning action that tightens and improves the flat-to-flat engagement between bearing surfaces 24 and 44 on the other lateral side 35*a* of the stock 30, as well as secures engagement between mating bearing surfaces 22 and 42.

It should be noted that the angular rotation and displacement of receiver 20 about longitudinal axis LA with respect to stock 30 that occurs is very slight as all four bearing surfaces 22, 24 and 42, 44 are initially lightly engaged when the receiver is positioned on the stock. However, the rotational or twisting moment Mt and force FT are sufficient with this slight angular displacement to improve and tighten the flat-to-flat surface engagement between bearing surfaces 24 and 44 as well as engagement between convex-to-flat bearing surfaces 22 and 42 (see FIGS. 9 and 10). Due to the convex shape of bearing, surface 42 on pillar lug 40 in stock 30, the downward vertical force Fv is translated in a rotational or twisting moment Mt and force Ft on the receiver 20. The resulting action is somewhat analogous to applying a torque wrench to the receiver 20 to tighten its engagement with the stock 30.

FIG. 10 shows receiver 20 in a final mounting and operational position on stock 30 with mounting fastener 12 fully tightened to a predetermined bolt torque. Rifle 10 is in a ready-to-fire condition. In one embodiment, bearing surface 22 of the receiver 20 engages substantially only the apex AP of the radiused and convex bearing surface 42 of the stock 30 when in the final mounting position (see FIG. 11). Top linear edge 42*a* and bottom linear edge 42*b* of the convex bearing surface 42 on pillar lug 40 and adjacent portions of surface 42 proximate to edges 42*a*, 42*b* do not engage bearing surface 22 of receiver 20. This approximates a linear axial contact between bearing surfaces 22 and 42 on left lateral side 35*b* of stock 30 as opposed to the flat-to-flat surface contact between bearing surfaces 24, 44 on the opposing right lateral side 35*a* of the stock which results in contact over a majority of the surface area of each mating bearing surface. Advantageously, only the mating flat bearing surfaces 24, 44 of the receiver and stock need to be machined to tolerances to achieve flat-to-flat surface contact whereas bearing, surface 22 can tolerate some slight non-planarity since this surface only engages the apex AP of bearing surface 42.

Overall, the present embodiment therefore beneficially creates a tighter and more stable bedding system that compensates for minor machining tolerance irregularities in the surface profile for the mating bearing surfaces on the receiver 20 and stock 30. This advantageously reduces or eliminates excessive movement and vibration between the receiver and stock when discharging the rifle, thereby enhancing accuracy by maintaining point of impact. Furthermore, extra machining operations and inspection for flat surface-to-surface contact between mating bearing surfaces can be eliminated also reducing manufacturing time and expense. A secure and stable stock bedding system according to embodiments of the present disclosure is therefore achievable which is not constrained by manufacturing tolerances.

When rifle 10 is discharged, the resulting recoil force will produce both axial forces attempting to drive the barrel-receiver combination 25/20 rearward and torsional or rotational forces attempting to rotate the forward muzzle end 25*b* of the barrel upwards (see FIG. 1). Both these axial and torsional/rotational recoil forces are translated through the barrel 25 to the receiver 20, and absorbed by the stock bedding system disclosed herein. The axial recoil forces are resisted via axial contact and support provided by rearward facing and a forward facing vertical thrust surface 48*a*, 48*b* on receiver 20 and mating forward facing and a rearward facing vertical thrust surface 49*a*, 49*b* on pillar lugs 40 in stock 30 (see FIGS. 2-7), as previously described herein. The torsional/rotational recoil forces are resisted by contact and support provided by the mating bearing surfaces 42, 44 on each pillar lug 40 and bearing surfaces 22, 24 on receiver 30 (see, e.g. FIGS. 2-11). Engagement between radiused and convex bearing surface 42 on each pillar lug 40 and its mating bearing surface 24 on receiver 30 ensure a tight fit which advantageously resists loosening under recoil.

Variations of a stock bedding system according to the present disclosure may be made in certain embodiments. For example, in some embodiments angled bearing surfaces 22, 24 may be formed on protrusions extending downwards from the bottom of the barrel-receiver assembly 25/20 instead of being formed within slots 48 as shown in FIGS. 2 and 12. Mating bearing surfaces 42, 44 in stock 30 may then be disposed in slots or recesses formed in the stock in lieu of the raised pillar lugs 40 shown in FIG. 3. Such arrangements may be particularly applicable where thrust surfaces 49*a*, 49*b* are formed separately and at a different axial location in stock 30 in some possible embodiments rather than being combined with the pillar lugs 40. Accordingly, numerous configurations and arrangements of mating bearing surfaces 22, 24 and 42, 44 possible so long as at least one of the four bearing surfaces has a transverse convex surface profile to achieve the rotational/rolling barrel-receiver assembly 25-20 mounting action described herein with all of its advantages.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A stock bedding system for a firearm comprising:

a receiver having a front end configured for coupling to a firearm barrel, the receiver defining a longitudinal axis and including a first bearing surface and a second bearing surface;

a stock having a third bearing surface and a fourth bearing surface, the third bearing surface being positioned to engage the first bearing surface when the receiver is mounted in the stock, and the fourth bearing surface being positioned to engage the second bearing surface when the receiver is mounted in the stock;

wherein the engagement between the first and third bearing surfaces is one of a convex to flat interface; and wherein the engagement between the second and fourth bearing surfaces is one of a flat to flat interface.

2. The stock bedding system of claim 1, wherein the first and second bearing surfaces are oriented at an angle with respect to the longitudinal axis.

3. The stock bedding system of claim 1, wherein the first and second bearing surfaces define a right and a left bearing surface on the receiver and the third and fourth bearing surfaces define a mating right and left bearing surface in the stock, the right bearing surfaces of the receiver and stock being mutually engaged and the left bearing surfaces of the receiver and stock being mutually engaged when the receiver is mounted in the stock.

4. The stock bedding system of claim 1, further comprising at least one mounting fastener extending through the stock and threadably engaging the receiver, the mounting fastener being configured and operable to draw the first and third bearing surfaces together and the second and fourth bearing surfaces together into mutual engagement when the mounting fastener is fully tightened with the receiver in a final mounting position in the stock.

5. The stock bedding system of claim 4, wherein the first or third bearing surface has a convex shaped profile that is structured and formed of a material that is not substantially deformable such that the bearing surface retains its convex shape profile when the receiver is mounted in the stock and the receiver is in the final mounting position in the stock.

6. The stock bedding system of claim 1, wherein the first and second bearing surfaces are each disposed in a slot formed on opposing lateral sides of the receiver.

7. The stock bedding system of claim 6, wherein the slots each define rearward and forward facing vertical thrust surfaces which are configured and arranged to axially engage corresponding forward facing and rearward facing vertical thrust surfaces formed on a pillar lug, the vertical thrust surfaces operable to prevent longitudinal axial movement of the receiver with respect to the stock.

8. The stock bedding system of claim 1, wherein the stock is made of a polymeric material.

9. The stock bedding system of claim 8, wherein the third and fourth bearing surfaces are defined on opposing sides of a pillar lug interlocked with the stock, the pillar lug having at least one lateral recess that receives a mating tab formed on stock for anchoring the pillar lug to the stock.

10. The stock bedding system of claim 4, wherein the third and fourth bearing surfaces are defined on opposing sides of a pillar lug interlocked with the stock, the mounting fastener extending through the pillar lug and engaging the receiver.

11. The stock bedding system of claim further comprising:

a fifth and a sixth bearing surface disposed in the receiver and spaced axially apart from the first and second bearing surfaces; and a seventh and eighth bearing surface configured and arranged in the stock for mating with the third pair bearing surfaces of the receiver, the fifth bearing surface being positioned to engage the seventh bearing surface when the receiver is mounted in the stock, and the sixth bearing surface being positioned to engage the eighth bearing surface when the receiver is mounted in the stock;

wherein the engagement between the fifth and seventh bearing surfaces is one of a convex to flat interface; and wherein the engagement between the sixth and eighth bearing surfaces is one of a flat to flat interface.

12. A stock bedding system for a firearm comprising:

a receiver having a front end configured for coupling to a firearm barrel, the receiver defining a longitudinal axis and a pair of opposing angled first and second bearing surfaces;

a stock having a bearing portion defining a longitudinally-extending channel configured for receiving at least part of the receiver therein;

a recoil pillar lug disposed in the channel and defining a pair of opposing angled third and fourth bearing surfaces configured and arranged for mating with the pair of first and second bearing surfaces of the receiver when the receiver is mounted to the stock, the third bearing surface of the pillar lug engaging the first bearing surface of the receiver, and the fourth bearing surface of the pillar lug engaging the second bearing surface of the receiver;

the first or third bearing surface of the receiver or stock respectively having a convex shaped profile and the other of the first or third bearing surface having a substantially flat shaped profile, the engagement between the first and third bearing surfaces being one of a convex to flat interface;

the second and fourth bearing surface each having a flat shaped profile, the engagement between the second and fourth bearing surfaces being one of a flat to flat interface.

13. The stock bedding system of claim 12, wherein the first and second bearing surfaces of the receiver are each disposed in a slot formed on opposing lateral skies of the receiver.

14. The stock bedding system of claim 13, wherein the slots each define rearward and forward facing vertical thrust surfaces which are configured and arranged to axially engage corresponding forward and rearward facing vertical thrust surfaces formed on the pillar lug, the vertical thrust surfaces operable to prevent longitudinal axial movement of the receiver with respect to the stock.

15. The stock bedding system of claim 12, wherein the first or third bearing surface having a convex shaped profile has a radius defining an apex, the other of the first or third bearing surface of the receiver or stock respectively having the substantially flat shaped profile engaging only the apex of the bearing surface when the receiver is in a final mounting and operational position in the stock.

16. The shack bedding system of claim 12, wherein the first or third bearing surface having a convex shaped profile is not plastically deformable thereby retaining the convex shaped profile when the receiver is in a final mounting and operational position in the stock.

17. A stock bedding system for a firearm comprising:

a receiver having a front end configured for coupling to a firearm barrel, the receiver defining a longitudinal axis, a rear end, a first lateral side having a portion including a first bearing surface, and a second lateral side having a portion including a second bearing surface;

a stock having a bearing portion defining a longitudinally-extending channel configured for receiving at least part of the receiver therein;

a recoil pillar lug mounted in the stock, the pillar lug defining a third bearing surface engaging the first bearing surface and a fourth bearing surface engaging the second bearing surface when the receiver is mounted in the stock;

wherein one of the first or third bearing surfaces has a non-planar convex profile and the remaining one of the first or third bearing surfaces has a substantially planar profile, the engagement between the first and third bearing surfaces being one of a convex to flat interface;

wherein the second and fourth bearing surfaces each have a flat shaped profile, the engagement between the second and fourth bearing surfaces being one of a flat to flat interface.

18. The stock bedding system of claim 17, wherein the third bearing surface of the pillar lug has an arcuate convex profile and the first bearing surface of the receiver has a substantially planar profile.

19. The stock bedding system of claim 18, wherein the third bearing surface extends from a top edge of the pillar lug to a bottom edge of the pillar lug, a majority of the surface area defined by the third bearing surface being arcuately curved between the top and bottom edges of the pillar lug.

20. The stock bedding system of claim 17, wherein the pillar lug includes a first lateral wing and a second lateral wing, each wing having a lateral recess that receives a tab formed on stock for anchoring and interlocking the pillar lug to the stock.

21. The stock bedding system of claim 17, wherein the first and second bearing surfaces of the receiver are each disposed in a slot formed in the receiver.

22. The stock bedding system of claim 21, wherein the slots each define rearward and forward facing vertical thrust surfaces which are configured and arranged to axially engage corresponding forward facing and rearward facing vertical thrust surfaces formed on the pillar lug, the vertical thrust surfaces operable to prevent longitudinal axial movement of the receiver with respect to the stock.

23. The stock bedding system of claim 17, further comprising at least one mounting fastener extending through the pillar lug and threadably engaging the receiver for mounting the receiver to the stock.

24. A method for mounting a receiver on a stock of a firearm, the method comprising:

positioning a receiver of a firearm defining a longitudinal axis on a stock, the longitudinal axis defining a first lateral side and a second opposite lateral side;

engaging a first convex shaped bearing surface disposed on the first lateral side of the stock or receiver with a mating second substantially flat bearing surface disposed on the first lateral side of the other of the stock or receiver;

engaging a third substantially flat bearing surface disposed on the second lateral side of the stock with another mating fourth substantially flat bearing surface disposed on the second lateral side of the receiver;

drawing the receiver downwards into stock with a threaded mounting fastener;

tightening the engagement between the first convex shaped bearing surface and the mating second substantially flat bearing surface;

creating a twisting force on the receiver that acts in a direction transverse to the longitudinal axis via interaction between the first convex shaped bearing surface and the mating second substantially flat bearing surface; and rotating the receiver from the first lateral side towards the opposite second lateral while maintaining engagement between the first convex shaped bearing surface and the mating second substantially flat bearing surface, wherein engagement between the third substantially flat bearing surface and the mating fourth substantially flat bearing surface is tightened.

25. The method of claim 24, wherein the first convex shaped bearing surface maintains its convex shape during the tightening step.

26. The method of claim 24, wherein the drawing step is performed by turning the mounting fastener.

27. The method of claim 24, wherein the first convex shaped bearing surface is disposed in the stock and the mating second substantially flat bearing surface is disposed on the receiver.

28. The method of claim 24, further comprising positioning rearward and forward facing vertical thrust surfaces associated with the second and fourth bearing surfaces to axially engage corresponding forward facing and rearward facing vertical thrust surfaces associated with the first and third bearing surfaces during the positioning step.

29. A stock bedding system for a firearm comprising:

a barrel having a forward muzzle end and a rear end with chamber configured for holding a cartridge;

a receiver having a front end coupled to the barrel, the receiver and barrel collectively defining a barrel-receiver assembly and longitudinal axis;

a first pair of right and left bearing surfaces disposed on the barrel-receiver assembly;

a stock having a second pair of right and left bearing surfaces configured and arranged in the stock for mating with the first pair bearing surfaces, the right bearing surface of the stock being positioned to engage the right bearing surface of the barrel-receiver assembly when the barrel-receiver assembly is mounted on the stock, and the left bearing surface of the stock being positioned to engage the left bearing surface of the barrel-receiver assembly when the barrel-receiver assembly is mounted on the stock;

wherein the engagement between the right bearing surfaces of the receiver and stock is one of a convex to flat interface; and wherein the engagement between the left bearing surfaces of the receiver and stock is one of a flat to flat interface.

* * * * *

UNITED STATES PATENT AND TRADEMARK OFFICE

CERTIFICATE OF CORRECTION

PATENT NO. : 8,881,444 B2
APPLICATION NO. : 13/715264
DATED : November 11, 2014
INVENTOR(S) : Scott Warburton et al.

It is certified that error appears in the above-identified patent and that said Letters Patent is hereby corrected as shown below:

In the Claims

Col. 13, line 23, insert --1-- between "claim" and "further"
Col. 13, line 67, change "skies" to --sides--
Col. 14, line 16, change "shack" to --stock--

Signed and Sealed this
Fourteenth Day of April, 2015

Michelle K. Lee

Michelle K. Lee
*Director of the United States Patent and Trademark Office*